US009530346B2

(12) United States Patent
Park

(10) Patent No.: US 9,530,346 B2
(45) Date of Patent: Dec. 27, 2016

(54) ORGANIC LIGHT-EMITTING DIODE DISPLAY AND METHOD OF DRIVING THE SAME

(71) Applicant: Samsung Display Co., Ltd., Yongin, Gyeonggi-Do (KR)

(72) Inventor: Jong-Woong Park, Yongin-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 21 days.

(21) Appl. No.: 14/562,431

(22) Filed: Dec. 5, 2014

(65) Prior Publication Data

US 2016/0019838 A1 Jan. 21, 2016

(30) Foreign Application Priority Data

Jul. 17, 2014 (KR) ..... 10-2014-0090241

(51) Int. Cl.
*G09G 3/32* (2016.01)

(52) U.S. Cl.
CPC ..... *G09G 3/3208* (2013.01); *G09G 3/3275* (2013.01); *G09G 2320/0626* (2013.01); *G09G 2360/16* (2013.01)

(58) Field of Classification Search
None
See application file for complete search history.

(56) References Cited

U.S. PATENT DOCUMENTS

| | | | | |
|---|---|---|---|---|
| 8,817,038 | B2 | 8/2014 | Choi et al. | |
| 2005/0212727 | A1 | 9/2005 | Lee | |
| 2013/0033517 | A1 | 2/2013 | Choi et al. | |
| 2014/0062989 | A1* | 3/2014 | Ebisuno | G09G 3/3241 345/212 |
| 2014/0375700 | A1* | 12/2014 | Takahama | G09G 3/2003 345/690 |

FOREIGN PATENT DOCUMENTS

| | | | |
|---|---|---|---|
| KR | 10-2005-0096082 | A | 10/2005 |
| KR | 10-2009-0043305 | A | 5/2009 |
| KR | 10-2013-0015179 | A | 2/2013 |
| KR | 10-2014-0040454 | A | 4/2014 |

* cited by examiner

*Primary Examiner* — Joseph Haley
(74) *Attorney, Agent, or Firm* — Knobbe Martens Olson & Bear LLP

(57) ABSTRACT

An organic light-emitting diode (OLED) display and a method of driving the display are disclosed. In one aspect, the method includes receiving input image data, calculating a load value corresponding to a driving amount of the input image data, and calculating a luminance adjustment value for each of the pixels based at least in part on the load value and a voltage drop proportional value of each of the pixels. The voltage drop proportional value corresponds to a ratio of a voltage drop value to a maximum voltage drop value. The method also includes generating output image data based at least in part on the input image data and the luminance adjustment value and displaying an image corresponding to the output image data.

19 Claims, 8 Drawing Sheets

ORGANIC LIGHT-EMITTING DIODE DISPLAY AND METHOD OF DRIVING THE SAME

CROSS-REFERENCE TO RELATED APPLICATIONS

This application claims priority under 35 U.S.C. §119 to Korean patent Application No. 10-2014-0090241 filed on Jul. 17, 2014, the disclosure of which is hereby incorporated by reference herein in its entirety.

BACKGROUND

Field

The described technology generally relates to an organic light-emitting diode display and a method of driving the same.

Description of the Related Technology

Generally, organic light-emitting diode (OLED) displays include a display panel and a panel driving unit. The display panel includes a plurality of scan lines, a plurality of data lines, and a plurality of pixels. The panel driving unit includes a scan driving unit providing scan signals to the scan lines and a data driving unit providing data signals to the data lines.

Due to self-emissive light functionality, OLED displays have favorable characteristics such as low power consumption, a wide viewing angle, a quick response time, and stability at low temperatures.

SUMMARY OF CERTAIN INVENTIVE ASPECTS

One inventive aspect is a method of driving an OLED display that can maintain a consistency of maximum luminance.

Another aspect is a method of driving an OLED display that includes an operation of receiving an input image data, an operation of calculating a load value indicating a driving amount of the input image data, an operation of calculating a luminance adjustment value for a plurality of pixels using the load value and a voltage drop proportional value of each of the pixels, the voltage drop proportional value indicating a ratio of a voltage drop value to a maximum voltage drop value, an operation of generating an output image data using the input image data and the luminance adjustment value, and an operation of displaying an image corresponding to the output image data.

The load value can be calculated according to Equation 1 below:

$$\text{Load}=K_r*\Sigma R_i+K_g*\Sigma G_i+K_b*\Sigma B_i, \qquad \text{Equation 1}$$

wherein Load is the load value, Ri is a red color image data included in the input image data, Gi is a green color image data included in the input image data, Bi is a blue color image data included in the input image data, Kr is a gain of the red color image data, Kg is a gain of the green color image data, and Kb is a gain of the blue color image data.

The load value can be calculated at an interval of a predetermined frame period.

The voltage drop proportional value can be determined to be greater than 0 and less than or equal to 1.

The voltage drop proportional value can be determined based on a distance between each of the pixels and a driving unit that drives the OLED display.

The luminance adjustment value can be determined by multiplying the voltage drop proportional value by a ratio of the load value to a maximum load value.

The output image data can be determined by multiplying the input image data by the luminance adjustment value.

The method can further include an operation of deriving a grayscale distribution value of the input image data, an operation of generating conversion information for stretching the input image data based on the grayscale distribution value, and an operation of the input image data using the conversion information.

An input grayscale value of the input image data can be transformed into an output grayscale based on the conversion information. A ratio of a change amount of the output grayscale value to a change amount of the input grayscale value can be proportional to the grayscale distribution value.

Another aspect is an OLED display that includes a display panel including a plurality of pixels, a scan driving unit configured to provide a scan signal to the pixels, a data driving unit configured to provide a data signal to the pixels, a data adjusting unit configured to calculate a load value indicating a driving amount of an input image data, and to generate an output image data by adjusting the input image data using the load value and a voltage drop proportional value of each of the pixels, the voltage drop proportional value indicating a ratio of a voltage drop value to a maximum voltage drop value, and a timing control unit configured to control the scan driving unit and the data driving unit to display an image corresponding to the output image data.

The data adjusting unit can include a load value calculating unit configured to calculate the load value from the input image data, a luminance adjustment value calculating unit configured to calculate a luminance adjustment value for the pixels using the load value and the voltage drop proportional value, and an output image data generating unit configured to generate the output image data using the input image data and the luminance adjustment value.

The load value can be calculated according to Equation 1 below:

$$\text{Load}=K_r*\Sigma R_i+K_g*\Sigma G_i+K_b*\Sigma B_i, \qquad \text{Equation 1}$$

wherein Load is the load value, Ri is a red color image data included in the input image data, Gi is a green color image data included in the input image data, Bi is a blue color image data included in the input image data, Kr is a gain of the red color image data, Kg is a gain of the green color image data, and Kb is a gain of the blue color image data.

The load value calculating unit can calculate the load value at an interval of a predetermined frame period.

The voltage drop proportional value can be determined to be greater than 0 and less than or equal to 1.

The voltage drop proportional value can be determined based on a distance between each of the pixels and the data driving unit.

The luminance adjustment value calculating unit can determine the luminance adjustment value by multiplying the voltage drop proportional value by a ratio of the load value to a maximum load value.

The output image data generating unit can determine the output image data by multiplying the input image data by the luminance adjustment value.

The data adjusting unit can further include a grayscale distribution analyzing unit configured to derive a grayscale distribution value of the input image data, a conversion information generating unit configured to generate conversion information for stretching the input image data based on the grayscale distribution value, and an image data converting unit configured to modulate the input image data using the conversion information.

The grayscale distribution analyzing unit can derive the grayscale distribution value by converting a format of the input image data to YCbCr-format.

An input grayscale value of the input image data can be transformed into an output grayscale based on the conversion information. A ratio of a change amount of the output grayscale value to a change amount of the input grayscale value can be proportional to the grayscale distribution value.

Another aspect is a method of driving an organic light-emitting diode (OLED) display comprising a plurality of pixels, the method comprising receiving input image data, calculating a load value corresponding to a driving amount of the input image data, and calculating a luminance adjustment value for each of the pixels based at least in part on the load value and a voltage drop proportional value of each of the pixels, wherein the voltage drop proportional value corresponds to a ratio of a voltage drop value to a maximum voltage drop value. The method also comprises generating output image data based at least in part on the input image data and the luminance adjustment value and displaying an image corresponding to the output image data.

In the above method, the load value is calculated according to Equation 1 below:

$$\text{Load}=K_r*\Sigma R_i+K_g*\Sigma G_i+K_b*\Sigma B_i,$$

wherein Load corresponds to the load value, Ri, Gi and Bi respectively correspond to red, green and blue color image data included in the input image data, and Kr, Kg and Kb respectively correspond to gains of the red, green and blue color image data.

In the above method, the load value is calculated every predetermined frame period.

In the above method, the voltage drop proportional value is greater than about 0 and less than or substantially equal to about 1.

In the above method, the voltage drop proportional value is determined based at least in part on distances between the pixels and a driver that drives the OLED display.

In the above method, the luminance adjustment value is determined by multiplying the voltage drop proportional value by a ratio of the load value to a maximum load value.

In the above method, the output image data is determined by multiplying the input image data by the luminance adjustment value.

The above method further comprises calculating a grayscale distribution value of the input image data, generating conversion information for stretching the input image data based at least in part on the grayscale distribution value, and modulating the input image data based at least in part on the conversion information.

In the above method, an input grayscale value of the input image data is transformed into an output grayscale based at least in part on the conversion information, wherein a ratio of a change amount of the output grayscale value to a change amount of the input grayscale value is proportional to the grayscale distribution value.

Another aspect is an organic light-emitting diode (OLED) display comprising a display panel including a plurality of pixels, a scan driver configured to provide a plurality of scan signals to the pixels, and a data driver configured to provide a plurality of data signals to the pixels. The OLED display also comprises a data adjuster configured to i) calculate a load value corresponding to a driving amount of input image data and ii) adjust the input image data based at least in part on the load value and a voltage drop proportional value of each of the pixels so as to generate output image data, wherein the voltage drop proportional value corresponds to a ratio of a voltage drop value to a maximum voltage drop value. The OLED display further comprises a timing controller configured to control the scan driver and the data driver so as to display an image corresponding to the output image data.

In the above OLED display, the data adjuster includes a load value calculator configured to calculate the load value based at least in part on the input image data. In the above OLED display, the data adjust further includes a luminance adjustment value calculator configured to calculate a luminance adjustment value for each of the pixels based at least in part on the load value and the voltage drop proportional value. In the above OLED display, the data adjust additionally includes an output image data generator configured to generate the output image data based at least in part on the input image data and the luminance adjustment value.

In the above OLED display, the load value calculator is further configured to calculate the load value according to Equation 1 below:

$$\text{Load}=K_r*\Sigma R_i+K_g*\Sigma G_i+K_b*\Sigma B_i,$$

wherein Load corresponds to the load value, Ri, Gi and Bi respectively correspond to red, green and blue color image data included in the input image data, and Kr, Kg and Kb respectively correspond to gains of the red, green and blue color image data.

In the above OLED display, the load value calculator is further configured to calculate the load value every predetermined frame period.

In the above OLED display, the voltage drop proportional value is greater than about 0 and less than or substantially equal to about 1.

In the above OLED display, the voltage drop proportional value is configured to be determined based at least in part on distances between the pixels and the data driver.

In the above OLED display, the luminance adjustment value calculator is further configured to multiply the voltage drop proportional value by a ratio of the load value to a maximum load value so as to determine the luminance adjustment value.

In the above OLED display, the output image data generator is further configured to multiply the input image data by the luminance adjustment value so as to determine the output image data.

In the above OLED display, the data adjuster further includes a grayscale distribution analyzer configured to calculate a grayscale distribution value of the input image data. In the above OLED display, the data adjuster further includes a conversion information generator configured to generate conversion information configured to stretch the input image data based at least in part on the grayscale distribution value. In the above OLED display, the data adjuster also includes an image data modulator configured to modulate the input image data based at least in part on the conversion information.

In the above OLED display, the grayscale distribution analyzer is further configured to convert a format of the input image data to YCbCr-format so as to calculate the grayscale distribution value.

In the above OLED display, the image data modulator is further configured to transform an input grayscale value of the input image data into an output grayscale based at least in part on the conversion information, wherein a ratio of a change amount of the output grayscale value to a change amount of the input grayscale value is proportional to the grayscale distribution value.

According to at least one of the disclosed embodiments, where the OLED display adjusts the input image data using the load value and the voltage drop proportional value, the OLED display and method of driving the same can maintain consistency of maximum luminance and improve a uniformity of luminance between the pixels located on different positions.

In addition, the OLED display and the method of driving the same can improve a visibility of the OLED display and reduce power consumption by stretching the input image data based on the grayscale distribution value of the input image data.

BRIEF DESCRIPTION OF THE DRAWINGS

Exemplary embodiments will be described more fully hereinafter with reference to the accompanying drawings, in which various embodiments are shown.

DETAILED DESCRIPTION OF CERTAIN INVENTIVE EMBODIMENTS

OLED displays including a large-scale display panel have image quality problems caused by a voltage drop because magnitude of the voltage drop increases as an amount of driving current increases. Methods of compensating the voltage drop in the display panel are being developed to prevent image quality degradation caused by the voltage drop. However, when an amount of a driving current is relatively large (e.g., when the organic light-emitting diode (OLED) display shows a white background image), it is difficult to maintain consistency of maximum luminance because the load value of image data is relatively large.

Exemplary embodiments will be described more fully hereinafter with reference to the accompanying drawings, in which various embodiments are shown. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
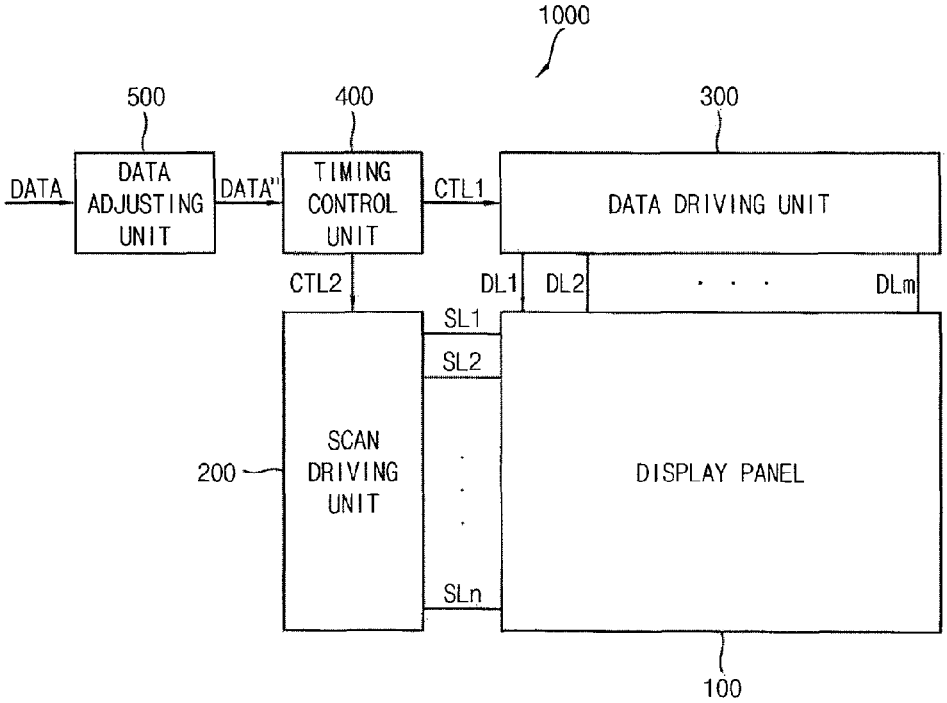
FIG. 1 is a block diagram illustrating an OLED display according to example embodiments.

FIG. 1 is a block diagram illustrating an OLED display according to example embodiments.

Referring to FIG. 1, an OLED display 1000 can include a display panel 100, a scan driving unit or scan driver 200, a data driving unit or data driver 300, a timing control unit or timing controller 400, and a data adjusting unit or data adjuster 500.

The display panel 100 is electrically connected to the scan driving unit 200 via scan lines SL1 through SLn. The display panel 100 is electrically connected to the data driving unit 300 via data lines DL1 through DLn. The OLED display 1000 can include n*m pixels because the pixels are arranged at locations corresponding to crossing points of the scan lines SL1 through SLn and the data lines DL1 through DLm.

The scan driving unit 200 can provide scan signals to the pixels via the scan lines SL1 through SLn.

The data driving unit 300 can provide data signals to the pixels via the data lines DL1 through DLn.

The data adjusting unit 500 can calculate a load value indicating a driving amount of an input image data DATA and generate an output image data DATA" by adjusting the input image data DATA using the load value and a voltage drop proportional value of each of the pixels. The voltage drop proportional value indicates a ratio of a voltage drop value to a maximum voltage drop value. Thus, the data adjusting unit 500 can adjust the input image data DATA using the load value and the voltage drop proportional value, thereby substantially maintaining consistency of maximum luminance in a white background image and improving a uniformity of luminance between the pixels located on different positions. Hereinafter, the data adjusting unit 500 will be described in detail with reference to the FIGS. 2 and 3.

The timing control unit 400 can generate control signals CTL1 and CTL2. The timing control unit 400 can respectively provide the control signals CTL1 and CTL2 to the scan driving unit 200 and the data driving unit 300. The timing control unit 400 can control the scan driving unit 200 or the data driving unit 300 to display images corresponding to the output image data DATA" generated by the data adjusting unit 500.

In addition, the OLED display 1000 can further include a power supply unit that supplies the high power voltage and low power voltage to the pixels and an emission driving unit that provides emission signals to the pixels.

Although it is illustrated in FIG. 1 that the data adjusting unit provides the output image data to the timing control unit, the data adjusting unit also can adjust the input image data and generate the output image data in various positions. For example, the data adjusting unit is included in the timing control unit or the data driving unit and adjusts the input image data.

Figure 2:
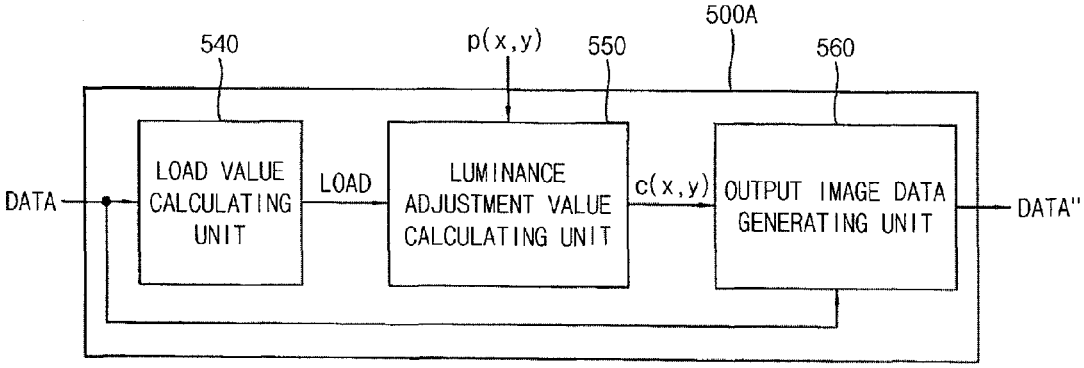
FIG. 2 is a block diagram illustrating one example of a data adjusting unit included in the OLED display of FIG. 1.

FIG. 2 is a block diagram illustrating one example of a data adjusting unit included in an OLED display of FIG. 1.

Referring to FIG. 2, the data adjusting unit 500A includes a load value calculating unit or load value calculator 540, a luminance adjustment value calculating unit or luminance adjustment value calculator 550, and an output image data generating unit or output image data generator 560.

The load value calculating unit 540 can calculate the load value LOAD from an input image data DATA. The load value LOAD indicates a driving amount of the input image data DATA. The load value LOAD can be substantially proportional to the grayscale of the input image data DATA. In some embodiments, the load value calculating unit 540 calculates the load value LOAD according to Equation 1.

$$Load=K_r*\Sigma R_i+K_g*\Sigma G_i+K_b*\Sigma B_i \quad \text{Equation 1}$$

where, Load is the load value, Ri is a red color image data included in the input image data, Gi is a green color image data included in the input image data, Bi is a blue color image data included in the input image data, Kr is a gain of the red color image data, Kg is a gain of the green color image data, and Kb is a gain of the blue color image data.

The Kr, Kg, and Kb can be determined to be greater than about 0 and less than or substantially equal to about 1 on an experimental basis. In embodiments, the load value calculating unit 540 calculates the load value LOAD at an interval of a predetermined frame period to reduce workload for calculating the load value LOAD. In some embodiments, the load value calculating unit 540 calculates the load value LOAD in every frame period to accurately measure the load value LOAD.

The luminance adjustment value calculating unit 550 can calculate a luminance adjustment value c(x,y) for the pixels using the load value LOAD and the voltage drop proportional value p(x,y). In some embodiments, the luminance adjustment value calculating unit 550 determines the luminance adjustment value c(x,y) by multiplying the voltage drop proportional value p(x,y) by a ratio of the load value LOAD to a maximum load value. Thus, the luminance adjustment value calculating unit 550 can calculate the luminance adjustment value c(x,y) according to Equation 2.

$$c(x,y)=p(x,y)*(LOAD/LOAD_MAX) \quad \text{Equation 2}$$

where, c(x,y) is a luminance adjustment value of a pixel located in the (x,y) position, p(x,y) is a voltage drop proportional value of the pixel located in the (x,y), LOAD is the load value, and LOAD_MAX is the maximum load value.

The voltage drop proportional value p(x,y) indicates a ratio of a voltage drop value to a maximum voltage drop value. Thus, the voltage drop proportional value p(x,y) is an adjusting value to compensate the voltage drop of the pixel located on (x,y) position. The voltage drop proportional value p(x,y) can be determined according to kinds of the display panel. In some embodiments, the voltage drop proportional value p(x,y) is determined to be greater than about 0, and less than or substantially equal to about 1.

In some embodiments, the voltage drop proportional value p(x,y) is determined based on a distance between each of the pixels and the data driving unit. The magnitude of voltage drop can increase as the distance between the pixel and the data driving unit increases. Therefore, the voltage drop proportional value p(x,y) can be determined in proportion to the distance between the pixel and the data driving unit.

When each the red color image data, the green color image data, and the blue color image data included in the input image data DATA has a maximum value, the load value LOAD can be the maximum load value. Therefore, when white image is displayed in the overall display panel, the load value LOAD is the maximum load value.

The output image data generating unit 560 can generate the output image data DATA" using the input image data DATA and the luminance adjustment value c(x,y). In some embodiments, the output image data generating unit 560 determines the output image data DATA" by multiplying the input image data DATA by the luminance adjustment value c(x,y). The output image data generating unit 560 can calculate the output image data DATA" according to following Equation 3.

$$Ro=c(x,y)*Ri,$$

$$Go=c(x,y)*Gi,$$

$$Bo=c(x,y)*Bi, \quad \text{Equation 3}$$

where, c(x,y) is a luminance adjustment value of a pixel located in the (x,y) position, Ro is a red color output image data, Ri is a red color input image data, Go is a green color output image data, Gi is a green color input image data, Bo is a blue color output image data, and Bi is a blue color input image data.

Therefore, the data adjusting unit 500A can calculate the load value LOAD and adjust the input image data DATA using the load value LOAD and the voltage drop proportional value p(x,y) of each of the pixels. The data adjusting unit 500A can generate the output image data DATA" that is proportional to the load value LOAD, thereby maintaining the consistency of maximum luminance regardless of the load value LOAD of the input image data DATA. The data adjusting unit 500A can prevent a luminance difference caused by the difference in size of white region of the input images.

In addition, the data adjusting unit 500A can generate the output image data DATA" that is proportional to the voltage drop proportional value p(x,y), thereby preventing the luminance difference caused by a difference in the voltage drop of the pixels located on different positions. Therefore, the data adjusting unit 500A can maintain consistency of maximum luminance and improve a uniformity of luminance between the pixels located on different positions by adjusting the input image data DATA.

Figure 3:
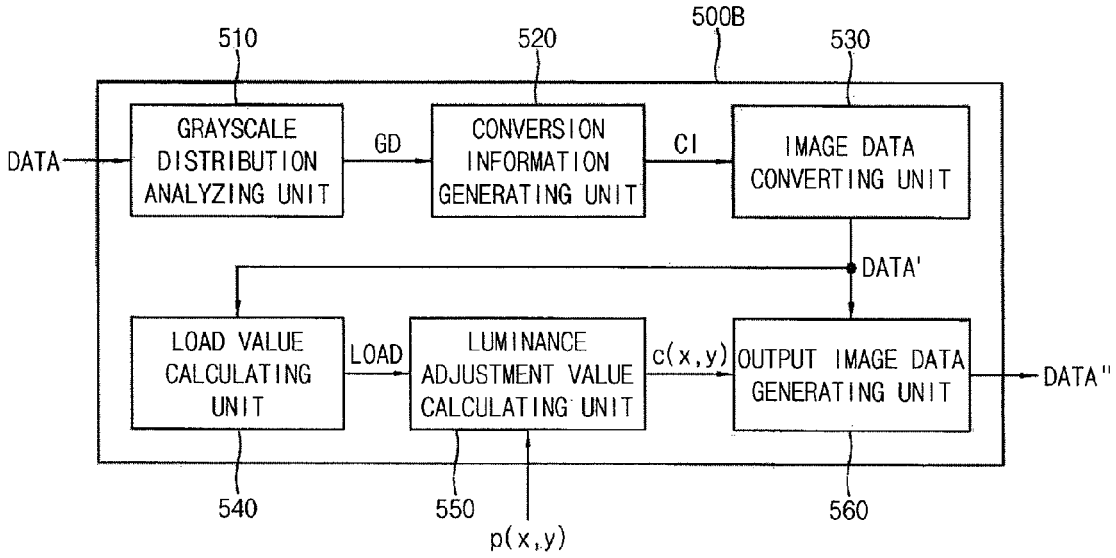
FIG. 3 is a block diagram illustrating another example of a data adjusting unit included in OLED display of FIG. 1.

FIG. 3 is a block diagram illustrating another example of a data adjusting unit included in an OLED display of FIG. 1.

Referring to FIG. 3, the data adjusting unit 500B includes a grayscale distribution analyzing unit or grayscale distribution analyzer 510, a conversion information generating unit or conversion information generator 520, an image data converting unit or image data converter or image data modulator 530, a load value calculating unit or load value calculator 540, a luminance adjustment value calculating unit or luminance adjustment value calculator 550, and an output image data generating unit or output image data generator 560.

The data adjusting unit 500B according to the present exemplary embodiment is substantially the same as the data adjusting unit of the exemplary embodiment described in FIG. 2, except that the grayscale distribution analyzing unit 510, the conversion information generating unit 520, and the image data converting unit 530 are added. Therefore, the same reference numerals will be used to refer to the same or like parts as those described in the previous exemplary embodiment of FIG. 2, and any repetitive explanation concerning the above elements will be omitted.

The grayscale distribution analyzing unit 510 can derive a grayscale distribution value GD of the input image data DATA. The grayscale distribution analyzing unit 510 can convert the grayscale of the input image data DATA to a numerical value to measure grayscale distribution of the pixels by analyzing the input image data DATA. In some embodiments, the grayscale distribution analyzing unit 510 measures grayscale of the pixels using weighted average values of the input image data DATA that is in the RGB-format, thereby deriving the grayscale distribution value GD. In some embodiments, the grayscale distribution analyzing unit 510 converts a format of the input image data DATA from RGB-format to YCbCr-format. Thereafter, the grayscale distribution analyzing unit 510 derives a grayscale distribution value GD. Thus, the format of the input image data DATA can be converted to YCbCr-format to stretch the input image data DATA. The YCbCr-format includes a luminance value Y and chrominance color values CbCr. For example, the luminance value Y is calculated according to Equation 4.

$$Y=Kr*R+Kg*G+Kb*B \quad \text{Equation 4}$$

where, Kr is a gain of the red color pixel, R is grayscale of the red color pixel, Kg is a gain of the green color pixel, G is grayscale of the green color pixel, Kb is a gain of the blue color pixel, and B is grayscale of the blue color pixel.

The conversion information generating unit 520 can generate conversion information CI for stretching the input image data DATA based on the grayscale distribution value GD. The conversion information CI can include various information to stretch the input image data DATA according to a degree of how much the pixels are clustered. In some embodiments, an input grayscale value of the input image data DATA is transformed into an output grayscale based on the conversion information CI. A ratio of a change amount of the output grayscale value to a change amount of the input grayscale value is substantially proportional to the grayscale distribution value GD. Thus, in a graph showing relationship between the input grayscale values and the output grayscale values, the slope of the graph can be substantially proportional to the grayscale distribution value GD. In addition, the slope of the graph can be smoothed to prevent screen distortion caused by sudden change of the conversion information CI.

The image data converting unit 530 can modulate the input image data DATA using the conversion information CI. For example, if the format of the input image data DATA was converted to YCbCr-format to derive the grayscale distribution value GD, the image data converting unit 530 modulates the luminance value Y. Thereafter, the image data converting unit 530 can convert the format of the input image data DATA from YCbCr-format to original format. The image data converting unit 530 can stretch the input image data DATA according to a degree of how much the pixels are clustered using the conversion information CI, thereby enhancing the contrast ratio of the display device.

The load value calculating unit 540 can calculate the load value LOAD from the modulated input image data DATA'. The luminance adjustment value calculating unit 550 can calculate a luminance adjustment value c(x,y) for the pixels using the load value LOAD and the voltage drop proportional value p(x,y). The output image data generating unit 560 can generate the output image data DATA" using the modulated input image data DATA' and the luminance adjustment value c(x,y). The load value calculating unit 540, the luminance adjustment value calculating unit 550, and the output image data generating unit 560 are described above, and therefore, duplicated descriptions will be omitted.

Therefore, the data adjusting unit 500B can stretch the input image data DATA based on the grayscale distribution value GD and adjust the stretched modulated input image data DATA' using the load value LOAD and the voltage drop proportional value p(x,y). The data adjusting unit 500B enhances the contrast ratio and improves visibility of the OLED display by stretching the input image data DATA according to degree of how much the pixels are clustered. The data adjusting unit 500B lowers the luminance of pixels that have luminance levels higher than necessary, thereby reducing the power consumption.

In addition, the data adjusting unit 500B can maintain consistency of maximum luminance regardless of the input image data DATA and improve a uniformity of luminance between the pixels located on different positions by generating the output image data DATA" that is substantially proportional to the load value LOAD and the voltage drop proportional value p(x,y).

Although it is illustrated in FIG. 3 that the output image data was generated after the input image data was stretched, the output image data can be stretched after the output image data is generated.

FIGS. 4 through 6 are diagrams illustrating consistency of maximum luminance in the OLED display 1000 of FIG. 1.

Referring to FIGS. 4 through 6, OLED display 1000 can maintain a consistency of maximum luminance regardless of the input image data.

Generally, OLED displays often displays the images having a white background. The white background images include a white background display region and a normal display region. When the white background display region is relatively large, the load value can be relatively high. Maximum luminance of images can be changed because the load values are changed based at least in part on the input image data (e.g., scale of the white background display region). Therefore, the OLED display needs to adjust the input image data based on the load value.

Figure 4B:
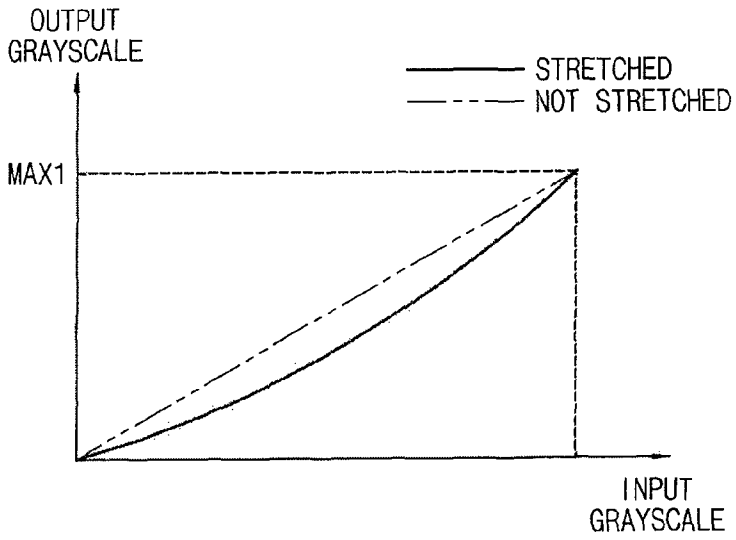
FIGS. 4A and 4B are diagrams illustrating consistency of maximum luminance in the OLED display of FIG. 1.
Figure 4A:
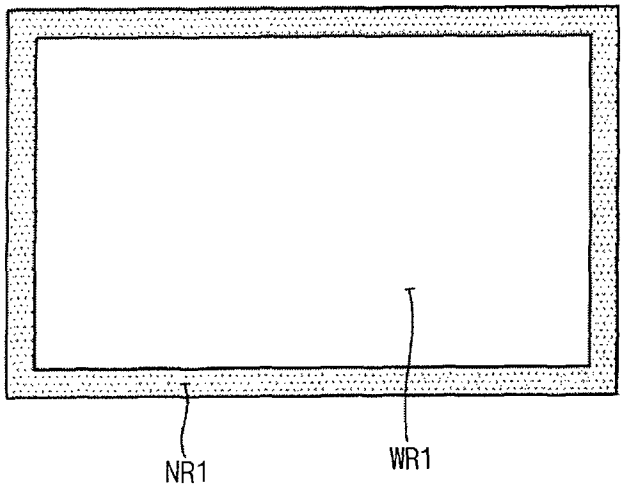
Figure 5B:
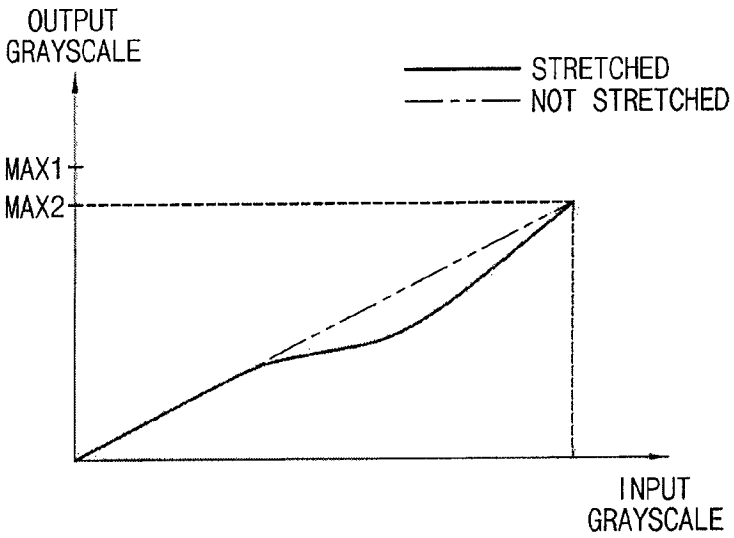
FIGS. 5A and 5B are diagrams illustrating consistency of maximum luminance in the OLED display of FIG. 1 when a white background display region is smaller than that shown in FIG. 4A.
Figure 5A:
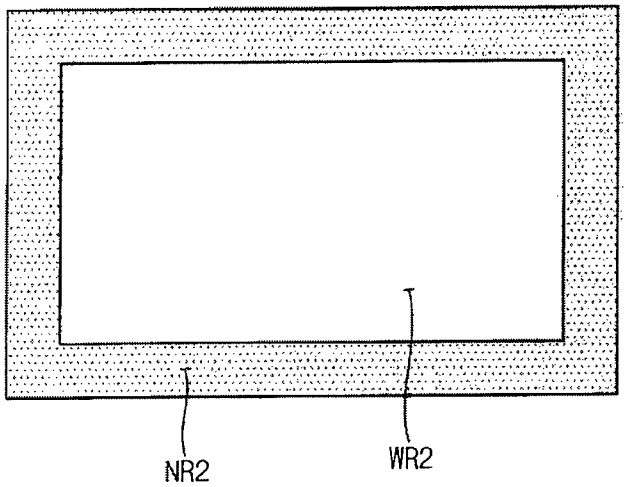
Figure 6B:
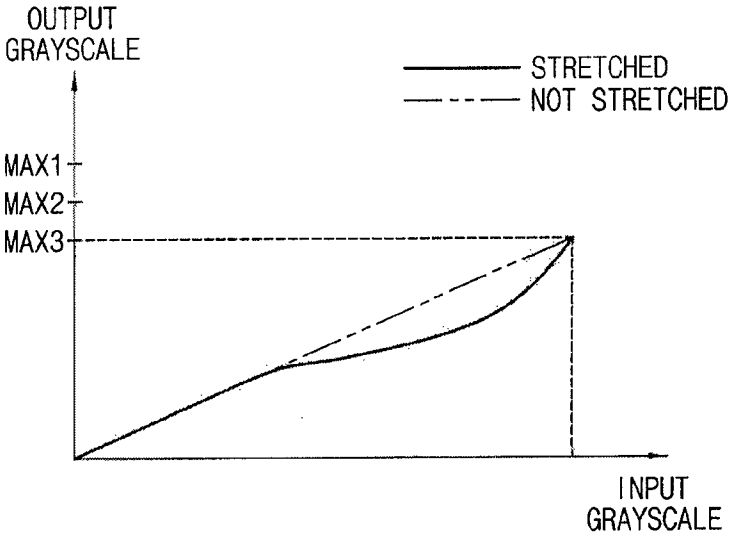
FIGS. 6A and 6B are diagrams illustrating consistency of maximum luminance in the OLED display of FIG. 1 when a white background display region is smaller than those shown in FIGS. 4A and 5A.
Figure 6A:
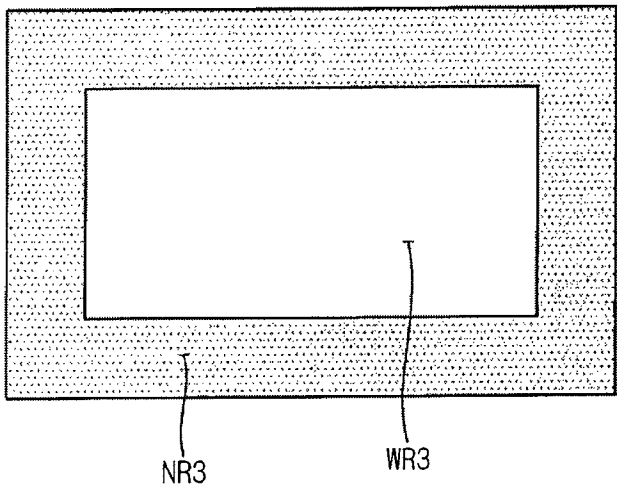

The OLED display 1000 can generate the output image data that is substantially proportional to the load value, thereby maintaining the consistency of maximum luminance regardless of the input image data. For example, the input image data is adjusted using the above Equations 1-3. As shown in FIGS. 4A and 4B, when the input image data includes the first white background display region WR1 of which scale is relatively large compared to a first non-white background display region NR1, the load value of the input image data can be high. Therefore, the output image data having the first maximum grayscale MAX1 is generated by adjusting the input image data based on the load value. As shown in FIGS. 5A and 5B, when the input image data includes the second white background display region WR2 of which scale is less than the scale of the first white background display region WR1, the output image data having the second maximum grayscale MAX2 is generated by adjusting the input image data based on the load value. Here, a second non-white background display region NR2 is greater than the first non-white background display region NR1. The second maximum grayscale MAX2 is less than the first maximum grayscale MAX1. As shown in FIGS. 6A and 6B, when the input image data includes the third white background display region WR3 of which scale is less than the scale of the second white background display region WR2, the output image data having the third maximum grayscale MAX3 is generated by adjusting the input image data based on the load value. Here, a third non-white background display region NR3 is greater than the first and second non-white background display regions NR1 and NR2. The third maximum grayscale MAX3 is less than the second maximum grayscale MAX2.

Therefore, when the OLED display 1000 displays images including white background display region, the OLED display 1000 can maintain consistency of maximum luminance regardless of scale of the white background display region (i.e., the load value of the input image data). In addition, the OLED display 1000 can stretch the input image data according to degree of the pixels are clustered, thereby improving a visibility of the display device.

Figure 7:
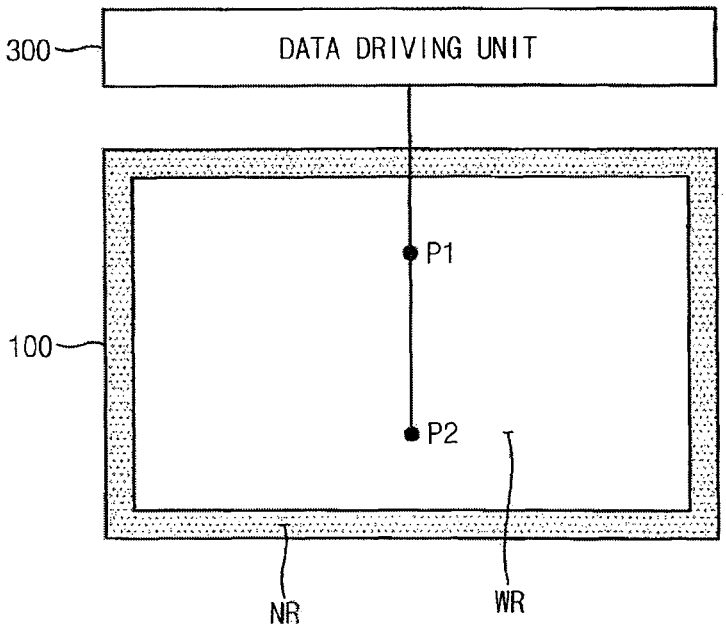
FIG. 7 is a diagram illustrating uniformity of luminance between the pixels in OLED display of FIG. 1.

FIG. 7 is a diagram illustrating uniformity of luminance between the pixels in an OLED display of FIG. 1.

Referring to FIG. 7, the OLED display 100 improves uniformity of luminance between the pixels located on different positions. The OLED display 1000 has a luminance difference caused by a difference in magnitude of the voltage drop because the magnitude of the voltage drop is changed corresponding to the position of the pixel. For example, when the first pixel P1 and the second pixel P2 display substantially the same grayscale, luminance of the second pixel P2 that is far from the data diving unit 300 compared with the first pixel P1 is lowered by the voltage drop. Therefore, the OLED display 1000 can adjust the input image data using the voltage drop proportional value, thereby preventing the luminance difference caused by a difference in magnitude of the voltage drop.

Figure 8:
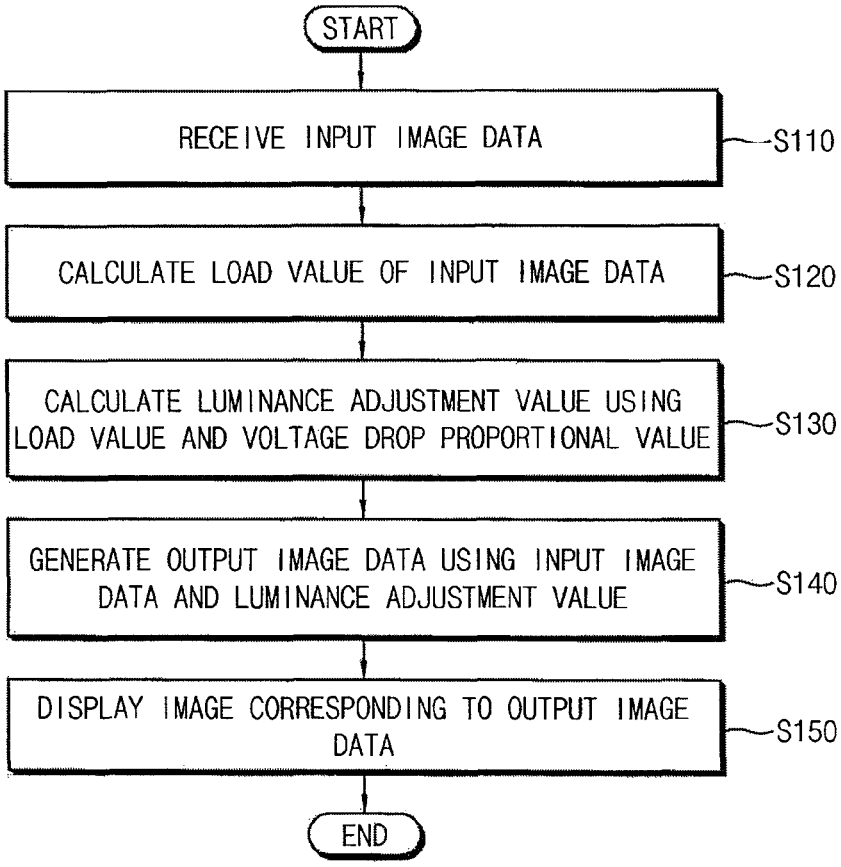
FIG. 8 is a flowchart illustrating a method of driving an OLED display according to one example embodiment.

FIG. 8 is a flowchart illustrating a method of driving an OLED display according to one example embodiment.

In some embodiments, the FIG. 7 procedure is implemented in a conventional programming language, such as C or C++ or another suitable programming language. The program can be stored on a computer accessible storage medium of the OLED display 1000, for example, a memory (not shown) of the OLED display 1000 or the timing control unit 400. In certain embodiments, the storage medium includes a random access memory (RAM), hard disks, floppy disks, digital video devices, compact discs, video discs, and/or other optical storage mediums, etc. The program can be stored in the processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor is implemented with a wide range of operating systems such as Unix, Linux, Microsoft DOS, Microsoft Windows 8/7/Vista/2000/9x/ME/XP, Macintosh OS, OS X, OS/2, Android, iOS and the like. In another embodiment, at least part of the procedure can be implemented with embedded software. Depending on the embodiment, additional states can be added, others removed, or the order of the states changed in FIG. 7. The description of this paragraph applies to the embodiments shown in FIG. 8.

Referring to FIG. 8, an input image data is received (S110) and a load value indicating a driving amount of the input image data is calculated (S120) from the input image data. The load value can be substantially proportional to grayscale of the input image data. In some embodiments, the load value is calculated according to the following Equation 1.

$$\text{Load}=K_r*\Sigma R_i+K_g*\Sigma G_i+K_b*\Sigma B_i \qquad \text{Equation 1}$$

where, Load is the load value, Ri is a red color image data included in the input image data, Gi is a green color image data included in the input image data, Bi is a blue color image data included in the input image data, Kr is a gain of the red color image data, Kg is a gain of the green color image data, and Kb is a gain of the blue color image data.

In some embodiments, the load value is calculated at an interval of a predetermined frame period to reduce workload for calculating the load value. In some embodiments, the load value is calculated in every frame period to accurately measure the load value.

A luminance adjustment value is calculated using the load value and a voltage drop proportional value of each of the pixels (S130). The voltage drop proportional value indicates a ratio of a voltage drop value to a maximum voltage drop value. In some embodiments, the luminance adjustment value is determined by multiplying the voltage drop proportional value by the ratio of the load value to a maximum load value. Thus, the luminance adjustment value can be calculated according to the following Equation 2.

$$c(x,y)=p(x,y)*(\text{LOAD}/\text{LOAD_MAX}) \qquad \text{Equation 2}$$

where, c(x,y) is a luminance adjustment value of a pixel located in the (x,y) position, p(x,y) is a voltage drop proportional value of the pixel located in the (x,y), LOAD is the load value, and LOAD_MAX is the maximum load value.

The voltage drop proportional value indicates the ratio of the voltage drop value to the maximum voltage drop value. Thus, the voltage drop proportional value is an adjusting value to compensate the voltage drop of the pixel located on (x,y) position. The voltage drop proportional value can be determined according to kinds of the display panel. In some embodiments, the voltage drop proportional value is determined to be greater than about 0, and less than or substantially equal to about 1.

In some embodiments, the voltage drop proportional value is determined based on a distance between each of the pixels and the data driving unit. The magnitude of voltage drop can increase as the distance between the pixel and the data driving unit increases. Therefore, the voltage drop proportional value can be determined to be substantially proportional to the distance between the pixel and the data driving unit.

When each the red, green, and blue color image data included in the input image data has the maximum value, the load value can be the maximum load value. Therefore, when white image is displayed in the overall display panel, the load value is the maximum load value.

An output image data is generated using the input image data and the luminance adjustment value (S140). An image corresponding to the output image data is displayed (S150). In some embodiments, the output image data is determined by multiplying the input image data by the luminance adjustment value. The output image data can be calculated according to the following Equation 3.

$$Ro=c(x,y)*Ri,$$

$$Go=c(x,y)*Gi,$$

$$Bo=c(x,y)*Bi, \qquad \text{Equation 3}$$

where, c(x,y) is a luminance adjustment value of a pixel located in the (x,y) position, Ro is a red color output image data, Ri is a red color input image data, Go is a green color output image data, Gi is a green color input image data, Bo is a blue color output image data, and Bi is a blue color input image data.

Therefore, a method of driving OLED display 1000 can maintain consistency of maximum luminance and improve the uniformity of luminance between the pixels located on different positions by adjusting the input image data using the load value and the voltage drop proportional value.

Figure 9:
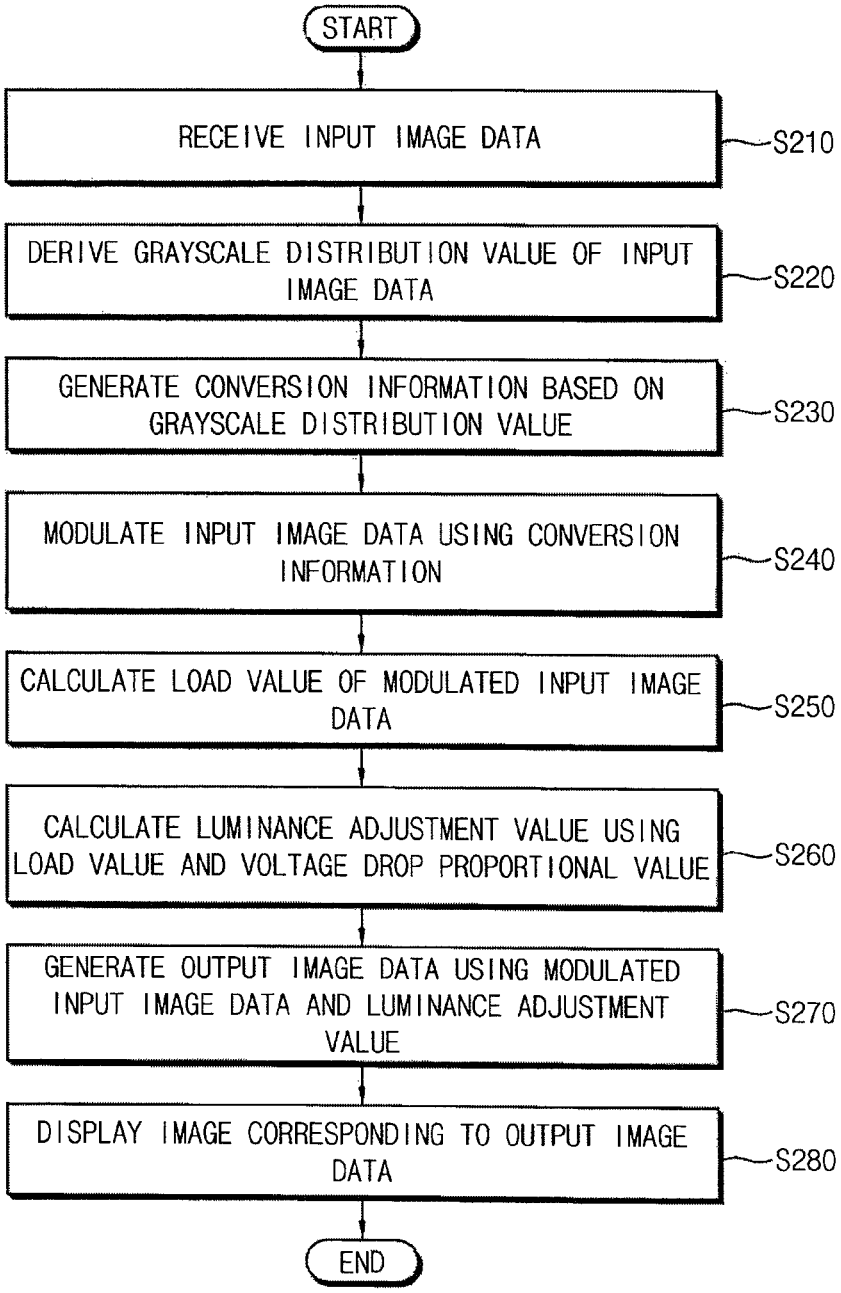
FIG. 9 is a flowchart illustrating a method of driving an OLED display according to another example embodiment.

FIG. 9 is a flowchart illustrating a method of driving an OLED display according to another example embodiment.

Referring to FIG. 9, an input image data is received (S210) and a grayscale distribution value of the input image data is derived (S220). In some embodiments, the grayscale distribution value is derived using weighted average values of the input image data of which format is RGB-format. In some embodiments, the grayscale distribution value is derived by converting a format of the input image data to YCbCr-format. Thus, the format of the input image data can be converted from RGB-format to YCbCr-format to stretch the input image data. The YCbCr-format includes a luminance value Y and chrominance color values CbCr. For example, the luminance value Y is calculated according to the following Equation 4.

$$Y=Kr*R+Kg*G+Kb*B \quad \text{Equation 4}$$

where, Kr is a gain of the red color pixel, R is grayscale of the red color pixel, Kg is a gain of the green color pixel, G is grayscale of the green color pixel, Kb is a gain of the blue color pixel, and B is grayscale of the blue color pixel.

Conversion information for stretching the input image data is generated based on the grayscale distribution value (S230). In some embodiments, an input grayscale value of the input image data is transformed into an output grayscale based on the conversion information. A ratio of a change amount of the output grayscale value to a change amount of the input grayscale value is substantially proportional to the grayscale distribution value. Thus, in a graph showing the relationship between the input grayscales value and the output grayscale values, the slope of the graph can be substantially proportional to the grayscale distribution value. In addition, the slope of the graph can be smoothed to prevent screen distortion caused by sudden change of the conversion information.

The input image data is modulated using the conversion information (S240). For example, if the format of the input image data was converted to YCbCr-format to derive the grayscale distribution value, the luminance value Y is modulated. Thereafter, the format of the input image data can be converted from YCbCr-format to RGB-format. The input image data is stretched according to the degree of how much the pixels are clustered using the conversion information, thereby enhancing the contrast ratio of the display device.

A load value indicating a driving amount of the modulated input image data is calculated (S250). A luminance adjustment value is calculated using the load value and the voltage drop proportional value of each of the pixels (S260). An output image data is generated using the modulated input image data and the luminance adjustment value (S270). An image corresponding to the output image data is displayed (S280). The operations of calculating the load value, calculating the luminance adjustment value, and generating the output image data are described above, duplicated descriptions will be omitted.

Therefore, the method of driving OLED display 1000 can improve a visibility by stretching the input image data based at least in part on the degree of how much the pixels are clustered. In addition, the method of driving OLED display 1000 can maintain the consistency of maximum luminance and improve the uniformity of luminance between the pixels located on different positions by adjusting the input image data using the load value and the voltage drop proportional value.

Although it is illustrated in FIG. 9 that the output image data was generated after the input image data was stretched, the operation of stretching image data can be performed after the output image data is generated.

Although, the example embodiments describe that the format of the input image data is RGB-format, the input image data can have various formats.

The described technology can be applied to an electronic device having the OLED display 1000. For example, the described technology can be applied to cellular phones, smartphones, tablet computers, personal digital assistants (PDAs), etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A method of driving an organic light-emitting diode (OLED) display comprising a plurality of pixels, the method comprising:

receiving input image data;

calculating a load value corresponding to a driving amount of the input image data;

calculating a luminance adjustment value for each of the pixels based at least in part on the load value and a voltage drop proportional value of each of the pixels, wherein the voltage drop proportional value corresponds to a ratio of a voltage drop value to a maximum voltage drop value;

adjusting the input image data based on the luminance adjustment value;

generating output image data based at least in part on the adjusted input image data; and displaying an, image corresponding to the output image data, wherein the luminance adjustment value is determined by multiplying the voltage drop proportional value by a ratio of the load value to a maximum load value.

2. The method of claim 1, wherein the load value is calculated according to Equation 1 below:

$$\text{Load}=K_r*\Sigma R_i+K_g*\Sigma G_i+K_b*\Sigma B_i,$$

wherein Load corresponds to the load value, Ri, Gi and Bi respectively correspond to red, green and blue color image data included in the input image data, and Kr, Kg and Kb respectively correspond to gains of the red, green and blue color image data.

3. The method of claim 2, wherein the load value is calculated every predetermined frame period.

4. A method of driving an organic light-emitting diode (OLED) display comprising a plurality of pixels, the method comprising:

receiving input image data;

calculating a load value corresponding to a driving amount of the input image data;

calculating a luminance adjustment value for each of the pixels based at least in part on the load value and a voltage drop proportional value of each of the pixels, wherein the voltage drop proportional value corresponds to a ratio of a voltage drop value to a maximum voltage drop value;

adjusting the input image data based on the luminance adjustment value;

generating output image data based at least in part on the adjusted input image data; and displaying an image corresponding to the output image data, wherein the voltage drop proportional value is greater than about 0 and less than or substantially equal to about 1.

5. The method of claim 1, wherein the voltage drop proportional value is determined based at least in part on distances between the pixels and a driver that drives the OLED display.

6. The method of claim 1, wherein the output image data is determined by multiplying the input image data by the luminance adjustment value.

7. The method of claim 1, further comprising:

calculating a grayscale distribution value of the input image data;

generating conversion information for stretching the input image data based at least in part on the grayscale distribution value; and modulating the input image data based at least in part on the conversion information.

8. The method of claim 7, wherein an input grayscale value of the input image data is transformed into an output grayscale based at least in part on the conversion information, and wherein a ratio of a change amount of the output grayscale value to a change amount of the input grayscale value is proportional to the grayscale distribution value.

9. An organic light-emitting diode (OLED) display comprising:

a display panel including a plurality of pixels;

a scan driver configured to provide a plurality of scan signals to the pixels;

a data driver configured to provide a plurality of data signals to the pixels;

a data adjuster configured to i) calculate a load value corresponding to a driving amount of input image data and ii) adjust the input image data based at least in part on the load value and a voltage drop proportional value of each of the pixels so as to generate output image data, wherein the voltage drop proportional value corresponds to a ratio of a voltage drop value to a maximum voltage drop value; and a timing controller configured to control the scan driver and the data driver so as to display an image corresponding to the output image data.

10. The display of claim 9, wherein the data adjuster includes:

a load, value calculator configured to calculate the load value based at least in part on the input, image data;

a luminance adjustment value calculator configured to calculate a luminance adjustment value for each of the pixels based at least in part on the load value and the voltage drop proportional value; and an output image data generator configured to generate the output image data based at least in part on the input image data and the luminance adjustment value.

11. The display of claim 10, wherein the load value calculator is further configured to calculate the load value according to Equation 1 below:

$$\text{Load}=K_r*\Sigma R_i+K_g*\Sigma G_i+K_b*\Sigma B_i,$$

wherein Load corresponds to the load value, Ri, Gi and Bi respectively correspond to red, green and blue color image data included in the input image data, and Kr, Kg and Kb respectively correspond to gains of the red, green, and blue color image data.

12. The display of claim 11, wherein the load value calculator is further configured to calculate the load value every predetermined frame period.

13. The display of claim 10, wherein the voltage drop proportional value is greater than about 0 and less than or substantially equal to about 1.

14. The display of claim 10, wherein the voltage drop proportional value is configured to be determined based at least in part on distances between the pixels and the data driver.

15. The display of claim 10, wherein the luminance adjustment value calculator is further configured to multiply the voltage drop proportional value by a ratio of the load value to a maximum load value so as to determine the luminance adjustment value.

16. The display of claim 10, wherein the output image data generator is further configured to multiply the input image data by the luminance adjustment value so as to determine the output image data.

17. The display of claim 10, wherein the data adjuster further includes:

a grayscale distribution analyzer configured to calculate a grayscale distribution value of the input image data;

a conversion information generator configured to generate conversion information configured to stretch the input image data based at least in part on the grayscale distribution value; and an image data modulator configured to modulate the input image data based at least in part on the conversion information.

18. The display of claim 17, wherein the grayscale distribution analyzer is further configured to convert a format of the input image data to YCbCr-format so as to calculate the grayscale distribution value.

19. The display of claim 17, wherein the image data modulator is further configured to transform an input grayscale value of the input image data into an output grayscale based at least in part on the conversion information, and wherein a ratio of a change amount of the output grayscale value to a change amount of the input grayscale value is proportional to the grayscale distribution value.

* * * * *